US007100668B2

(12) United States Patent
Allsop

(10) Patent No.: US 7,100,668 B2
(45) Date of Patent: Sep. 5, 2006

(54) CONTROL UNITS

(75) Inventor: Reginald Charles Allsop, Cheshire (GB)

(73) Assignee: Louver-Lite Limited, Cheshire (GB)

( * ) Notice: Subject to any disclaimer, the term of this patent is extended or adjusted under 35 U.S.C. 154(b) by 191 days.

(21) Appl. No.: 10/662,078

(22) Filed: Sep. 12, 2003

(65) Prior Publication Data

US 2005/0039866 A1 Feb. 24, 2005

(30) Foreign Application Priority Data

Aug. 19, 2003 (GB) ..... 0319396.8

(51) Int. Cl.
*E06B 9/20* (2006.01)

(52) U.S. Cl. ..... 160/321; 160/323.1

(58) Field of Classification Search ..... 160/323.1, 160/321, 300, 301, 307, 903, 24, 315, 23.1, 160/302, 191, 192, 383, 395, 392, 403, 405
See application file for complete search history.

(56) References Cited

U.S. PATENT DOCUMENTS

| | | | | |
|---|---|---|---|---|
| 4,009,745 | A * | 3/1977 | Erpenbeck | 160/297 |
| 4,372,432 | A * | 2/1983 | Waine et al. | 192/223.4 |
| 4,751,953 | A * | 6/1988 | Appel et al. | 160/313 |
| 4,865,109 | A | 9/1989 | Sherman | |
| 5,029,629 | A * | 7/1991 | Cheng-Pei | 160/300 |
| 5,361,822 | A | 11/1994 | Nijs | |
| 5,375,643 | A | 12/1994 | Rude | |
| 5,507,374 | A * | 4/1996 | Rude | 192/223.3 |
| 6,116,325 | A * | 9/2000 | Colson et al. | 160/321 |
| 6,173,825 | B1 | 1/2001 | Liu | |
| 6,457,688 | B1 * | 10/2002 | Welfonder | 248/266 |
| 2003/0085003 | A1 | 5/2003 | Cheng | |

FOREIGN PATENT DOCUMENTS

| | | |
|---|---|---|
| DE | 200 22 527 | 10/2001 |
| EP | 0 481 688 | 10/1991 |
| EP | 0 717 166 | 6/1996 |
| EP | 0 869 254 | 10/1998 |
| EP | 0 940 553 | 9/1999 |
| EP | 0 972 906 | 1/2000 |
| EP | 0 976 909 | 2/2000 |
| FR | 2 800 121 | 4/2001 |
| GB | 2 181 475 | 4/1987 |
| GB | 2 313 143 | 5/1997 |
| GB | D 2104201 | 10/2001 |
| GB | D 2106405 | 1/2002 |
| GB | D 3006555 | 9/2002 |
| JP | 09 310 570 | 12/1997 |
| WO | 94/15057 | 7/1994 |
| WO | 96/05400 | 2/1996 |

* cited by examiner

*Primary Examiner*—David Purol
(74) *Attorney, Agent, or Firm*—Mark J. Burns; Haugen Law Firm PLLP

(57) ABSTRACT

A control unit for use in a window blind head rail assembly includes a sprocket wheel, a chain guard housing, a sprocket support and wrap spring, a splined bush for engagement with a roller blind tube and a center pin, wherein the center pin has a center-pin head and a body, the center-pin head including one or more fins adapted to co-operatively engage with one or more recesses in the sprocket support.

9 Claims, 14 Drawing Sheets

CONTROL UNITS

FIELD OF THE INVENTION

The present invention relates to improvements in control units, specifically to control units for window blind systems.

BACKGROUND OF THE INVENTION

Due to the general inaccessibility of window blind head rails, and the complexity of modern blinds, it is necessary for window blinds to comprise a control unit, and many types are known in the art. The nature of the control unit will vary according to the type of blind with which it is being used, and the present invention relates in particular to improvements in a control unit suitable for use with a manually operated roller blind type head rail.

Head rails of this type may be used to hang any suitable blind where a control unit as described can be applied, but most commonly roller blinds.

A control unit for use with a roller blind type head rail will typically include a sprocket wheel in connection with a chain, a chain guard housing, and a sprocket support which facilitates controlled rotation of a splined bush. The sprocket wheel rotates in response to movement of the chain by the user, with the sprocket support providing a controlled and limited resistance to rotation. This in turn causes the splined bush to rotate. The control unit engages the roller blind tube, causing an attached blind to raise or lower as a result of the operation of the chain. In this way, movement of the blind from an open to a closed position is achieved without excessive stretching or discomfort to the individual.

This mechanism is exemplified by the roller blind control units sold by Louver-Lite Limited in five sizes corresponding to their System 32, 40, 40+, 45 or 45+ roller blind ranges.

This unit comprises a sprocket wheel and housing. The sprocket wheel interacts with a typical wrap spring having outwardly projecting end juts. The wrap spring is in turn connected to a sprocket support by a sprocket spring friction surface. The sprocket support includes two engaging pins projecting from one face of the control unit. These are designed to engage with a metal or plastic wall or ceiling-mounted bracket, thereby providing a means for hanging the blind in front of a window or other aperture.

In a variation on this design, as shown in UK design registration no 3006555, the sprocket support also features a radially extending projection which interacts with one of three distinct channels in the chain guard housing adapted to receive the projection. This allows the chain guard housing to be locked into one of three positions relative to the sprocket support when the blind unit is fitted. This stabilises the unit, with the chain guard housing aperture in an appropriate position in view of the location in which the blind is to be hung, whilst preventing independent movement of these two components. For example, if the blind is to be hung over a window with nothing positioned below the window to impede user access, the radially extending projection may be positioned to interact with the central channel. This allows the blind chain to hang along side and more or less parallel to the plane of the blind. However, if the blind is to be hung, for instance, at a kitchen window, behind a sink, the radially extending projection may be placed in one of the two side channels, causing the chain to project from the plane of the blind, and be reached more easily by the user.

In all of the above referred to embodiments, movement of the roller blind chain causes rotation of the sprocket wheel and releases the wrap spring clutch. The sprocket wheel component of this control unit also interacts with a splined bush which, as a result, rotates upon movement of the sprocket wheel. The external surface of the splined bush is connected with the roller blind tubing, thereby facilitating rotation and therefore raising or lowering of the blind as a result of movement of the chain.

The units are held together by a centre pin which extends substantially through the centre of the control unit. The head of the pin comprises a locking-lug of the centre-pin stop element typically in the form of co-operating flattened surfaces in what is otherwise a tubular interface between the centre pin and the sprocket support. The locking-lug of the centre-pin stop element engages the sprocket support and provides an additional point of connection with the mounting bracket. The hooked tip of the centre-pin stop element prevents the blind from being pulled out of the bracket if the chain is pulled at a non-orthogonal angle from the aperture of the chain guard housing. The splined bush snap fits over the centre-pin tips whereby the two locking lugs of the centre pin engage a centre-pin engagement surface of the splined bush.

However, there are features of the above design which could be improved. For instance, the chain guard housing of this design is known to suffer from damage when the chain is roughly handled or yanked by the user.

It is also desirable to provide a control unit that does not need to be dismantled in order to feed the chain into position with the sprocket wheel. Known control units are designed to be dismantled in order to complete this process. However, dismantling the unit is time consuming, and many blind assemblers force the chain to engage with the sprocket wheel without dismantling the unit, thereby risking damage to both the wheel and the housing.

SUMMARY OF THE INVENTION

Therefore, according to a first aspect of the invention, there is provided a control unit for blinds which comprises a sprocket wheel and chain guard housing which is rotatable relative to the external face of the sprocket support. The external face of the sprocket support and the chain guard housing form one face of the control unit. Although the external face of the sprocket support is loosely and releasably retained in a preferred position relative to the sprocket wheel and the chain guard housing by the incorporation of cooperating detent means such as cooperating small projections and recesses, the two components may move relative to one another when a certain minimum threshold of rotational pressure is applied to the unit. The rotational degree of freedom created by this feature is such that the chain guard housing may rotate through 360 degrees relative to the external face of the sprocket support. The additional movement created by this change decreases the wear and damage caused by rough handling of the chain, and allows the roller blind chain to be fed into the sprocket wheel mechanism without dismantling the unit.

There is therefore provided a control unit for use in a window blind head rail assembly comprising; a sprocket wheel, a chain guard housing which may be rotated relative to a sprocket support, a sprocket support and wrap spring, a splined bush for engagement with a roller blind tube and a centre pin.

In addition, the control unit is sometimes awkward to fit. When positioning a heavy blind it can be troublesome to align the locking-lug of the centre-pin stop element correctly such that it engages with the mounting bracket.

According to a further aspect of the invention, there is provided a control unit for blinds wherein the chain guard housing includes a lug extending perpendicular to the face of the control unit which incorporates the sprocket support. Conventionally, the lug extends axially.

The addition of this feature provides a simple reference, which can be used by the blind assembler to correctly position the control unit to engage the mounting bracket, which can in turn help to ensure that the opening of the chain guard housing points vertically downwards, and hence can help prevent wear and tear. Further, the lug serves to prevent rotation of the chain guard housing during the raising of the blind.

Another problem associated with control units of this type is wear of the various components during use. Of particular concern is the wear of the locking-lug of the centre-pin stop element and the surfaces of the sprocket wheel which are in contact with the wrap spring.

Therefore, according to another aspect of the invention there is provided a control unit for blinds wherein the centre-pin comprises one or more fins which project axially from the centre-pin head and are adapted to engage with co-operating recesses in the sprocket support.

This reduces the rotational degree of freedom available to the centre-pin head, and negates the wear of this component due to the rotational stress applied by the blind.

In particular, it allows the manufacture of certain control end components such that the tolerances are not too critical, and yet in the resulting assembled control end there is minimal play around the sprocket support. This has the effect again of reducing wear and tear, especially in larger or heavier blinds.

According to yet a further aspect of the invention, there is provided a control unit for blinds having a generally circular cross section wrap spring, and wherein the wrap spring juts have been modified such that each jut has one or more flattened surfaces, and if only one surface has been flattened that this is on the face of the jut which contacts the edges of the cutaway portion of the sprocket wheel. Changing the cross-sectional shape of the juts in this way increases the contact of the spring with the sprocket wheel contact surface, improving purchase and decreasing wear of the sprocket wheel in use.

There is therefore provided a control unit for use in a window blind head rail assembly comprising; a sprocket wheel, a chain guard housing, a sprocket support and wrap spring, a splined bush for engagement with the roller blind tube and a centre pin, wherein the centre pin comprises a centre-pin head, and a body, the centre-pin head including one or more fins adapted to co-operatively engage with one or more recesses in the sprocket support.

The chains suitable for use with this control unit would be well known to a person skilled in the art, and will typically be of either metal or plastic construction. Integral to the chain are a series of regularly spaced balls which when fed through the control unit interact with the sprocket wheel causing it to rotate.

With the exception of the wrap spring, the components of the control unit will typically be made from polymer plastics materials. The different components may be made from any thermoplastics materials, such as e.g. nylon, which are compatible with modern injection moulding techniques and known to those skilled in the art. Alternatively, where appropriate components may be made out of metals.

Preferably, each individual component of the invention is formed separately from the other components and when made from plastics from one piece of moulded plastics material.

In use, the sprocket wheel interacts with the chain and the wrap spring causing controlled rotation of the wrap spring when the user moves the chain. Additionally, a moulded indent as the spline bush interacts with a cutaway portion on the sprocket wheel, allowing for transfer of rotational force generated by pulling the chain to the splined bush. This, in turn, causes the splined bush, itself engaged with the roller blind tubing, to rotate causing the blind to move up or down in line with the direction in which the user pulls the chain.

Where present the chain guard housing of the invention covers the sprocket wheel and is substantially flush with the external face of the sprocket support when the unit is assembled. Covering the sprocket wheel in this way prevents the chain from becoming dislodged during use and provides a more aesthetically pleasing unit to the user.

The unit may comprise a chain guard housing element similar to that known from British Design registration number 3006555 which prevents fouling of the sprocket wheel mechanism during use. With earlier models of the control unit, fouling typically occurred where the connector which joins the chain ends to form a loop, becomes jammed between the chain guard housing and the sprocket support wheel itself. As the connector is larger than the regularly spaced balls found along the chain, this component becomes jammed and may damage the unit. The modified housings of British Design registration number 3006555 and the invention provide a narrowed aperture, preventing the connector from contacting the sprocket wheel.

The chain guard housing of the invention is designed to be rotatable relative to the sprocket support. This allows the chain to be fed into the sprocket wheel without the need to dismantle the unit, reduces the risk to children associated with this product, and prevents damage to the sprocket wheel by the chain connectors.

In a preferred feature, the sprocket support and the chain guard housing have a preferred relative orientation to one another. This is of particular use in ensuring that the components which make up this face of the control unit are correctly aligned during fitting so that they may engage the mounting bracket correctly.

The sprocket support and chain guard housing are designed to include means which provide a preferred orientation between the components, but which is releasable allowing the sprocket support and the chain guard housing to rotate relative to one another in use. A preferred method of facilitating this is the inclusion of a small groove in the chain guard housing, which interacts co-operatively with a small rounded projection on the sprocket support which allow the chain guard housing and the sprocket support to be releasably detained in a preferred configuration. The size of the rounded projection, and the degree of freedom between the sprocket support and the chain guard housing allow the chain guard housing and the sprocket support to be rotated independently of one another, yet provides for a preferred orientation during normal use. The rounded projection and groove may be positioned at any point around the edge of the external face of the sprocket support. However, preferably, the rounded projection and groove are positioned at the bottom of the external face of the sprocket support in use.

Optionally, the chain guard housing may also include one or more positioning lugs, which extend perpendicular to the face of the control unit which incorporates the sprocket support. This makes it easier for the blind assembler to position the blind during hanging and limits the rotation of the control unit in the mounting bracket during use. Limiting the rotational freedom of the control unit decreases wear and tear on the unit and eliminates the consumer undesirable 'tapping' noise. The one or more positioning lugs may be positioned at any point around this face of the control unit, and may be connected to either the chain guard housing or to the sprocket support. Preferably, there will be between one and three lugs. Most preferably there will be one lug only; preferably the lug or lugs will be position on the chain guard housing. Typically, although not exclusively, the lug will extend from the face of the control unit incorporating the sprocket support, and from the edge opposite to the chain guard housing aperture. Even more preferably, the lug will be aligned with the short axis of the locking-lug of the centre-pin stop element.

There is therefore provided a control unit for use in a window blind head rail assembly, wherein the chain guard housing includes one or more positioning lugs which extend perpendicular to the face of the control unit incorporating the sprocket support.

Dedicated mounting brackets are required for use with the control unit of the invention. These may be plastic or metal. Typically each bracket is L-shaped and includes holes for receiving screws or other means suitable for attaching the bracket to the wall or other surface. The brackets will also include cavities or channels adapted to receive the locking-lug of the centre-pin stop element and engagement pins on the control end. Brackets for use with embodiments of the invention comprising the positioning lug or lugs extending from the control unit require the presence of the requisite number of additional cooperating channels in the bracket; typically, a plastics bracket will be made from thermoplastic materials such as e.g. nylon, which are compatible with modern injection moulding techniques. Suitable metal brackets may be made from any suitable metal, but will preferably be made from aluminium or steel, most preferably from painted steel.

The control unit also includes a sprocket support. The sprocket support comprises a roughly cylindrical portion and connected to one end, a collar, which forms the external face of the sprocket support, and which is substantially annular. The cylindrical element of this component extends directly from the inner edge of the sprocket support face engaging the sprocket wheel and providing a friction surface for interaction with the wrap spring. It is the interaction of this surface with the wrap spring which controls the speed of rotation of the elements of the control unit in use.

Preferably, the external face of the sprocket support comprises one or more engaging pins for engagement with the window blind mounting bracket. Typically, there will be two engaging pins. The sprocket support face rotates within the chain guard housing; optionally, one or more small angular projections will extend radially from the external face of the sprocket support. The angular projections are in contact with the smooth inner surface of the chain guard housing and create a small degree of friction between the sprocket support and the chain guard housing. This provides an additional means of minimising the relative movement of the two components during use, but additionally allows the chain guard housing and sprocket to be made to reasonable tolerances. Preferably, there are at least three angular projections; in other embodiments the angular projections may actually be surfaces which make up for example one fifth or a quarter of the circumference of the outer annular surface of the sprocket support.

Additionally, the external face of the sprocket support of the invention may include one or more rounded projections as described immediately above.

Further, the external face of the sprocket support may include one or more recesses around the inner edge of the annular collar which forms this face of the sprocket support. These are adapted to engage with one or more fins which may optionally be present on the locking-lug of the centre-pin stop element.

The centre pin extends from the face of the control unit incorporating the sprocket support, through the control unit to the rear of the unit. At the head of the centre pin is the locking-lug of the centre-pin stop element. The centre-pin head may comprise one or more fins extending radially from the stop element and engaging with cooperating recesses in the annular internal face of the sprocket support. It is particularly advantageous for the fins to be present in control units for use with larger blinds, as the fins reduce the rotational movement available to the centre-pin head and stop element. This movement can damage the locking-lug of the centre-pin stop element. The movement occurs as a result of the torsional stress applied by the blind and in larger blinds, which are therefore heavier, the torsional stress on this component is greater. When present, there will typically be between at least one and seven fins, which preferably will be equally spaced around the circular portion of the periheral surface of the centre-pin. Conveniently, there will be three.

Conveniently the fins may run the whole length of the centre pin; alternatively they may be tapered along the length of the pin, having a maximum annular length nearest the head of the centre pin, and tapering to nothing at a point along the centre pin remote from the head of the centre pin. In certain embodiments the fins may extend outwards from the centre pin a distance of up to about 4 mm; conveniently the fins will extend a distance of between 1 mm and 3 mm outwards from the centre pin adjacent to the centre pin head.

If fins are utilized on the centre pin, in all instances the recesses on the annular internal face of the sprocket support are dimensioned and positioned so as to cooperate with the fins.

The body of the centre pin will typically extend substantially through the centre of the control unit. At the tip of the centre pin, are two locking lugs, as is well known in the art. A splined bush snap fits over the centre pin whereby the locking lugs of the centre pin engage the centre-pin engagement surface. Alternative ways, such as using star washers, etc exist for anchoring the centre pin and the splined bush in the control unit, but the use of integral locking lugs provides a cheap and reliable means of securing the centre pin.

There is therefore provided a control unit for use in a window blind head rail assembly, wherein the centre-pin head comprises one or more fins adapted to engage with operating recesses in the annular internal face of the sprocket support.

The splined bush has a moulded indent portion which in the assembled unit sits within, and upon relative rotation contacts the cutaway portion of the sprocket wheel component. As the sprocket wheel rotates, an edge of the cutaway portion rotates to contact an edge of the moulded indent on the splined bush, and the splined bush is caused to rotate. It is the rotation of splined bush caused by rotation of the sprocket wheel which causes the tube to rotate, in turn causing the blind to be raised or lowered as required.

The control unit of the invention may be further improved through the optional inclusion of a modified wrap spring. The wrap springs of the prior art are either of wholly circular or rectangular cross-section. However, the preferred spring of the invention is preferably neither of these. The cross-section of the spring body is circular, and the spring juts (i.e. the ends of the spring, which typically point radially outwards) have been flattened on one or more faces to form a non-circular cross-section. Where one face only has been flattened, it is the face which contacts the edge of the cutaway portion of the sprocket wheel which is modified. Preferably, for ease of manufacture, two substantially opposing sides of each of the wrap spring juts have been flattened.

This simple change helps overcome the problem of wear of the sprocket wheel contact surface due to the constant rubbing of the jut against the surface without having to accept the known disadvantage that springs with rectangular-cross-sections have different gripping characteristics to the preferred springs featuring circular cross-sections in friction based applications. In addition, the purchase of the flattened jut with the sprocket wheel contact surface which is located on the cutaway portion of the sprocket wheel is improved, due to the increase in surface area contact between the two components.

The wrap spring is formed from metal, or a plastics material, preferably from metal and more preferably from steel.

There is therefore provided a control unit for use in a window blind head rail assembly, the wrap spring coil having a circular cross-section and having wrap spring juts which are modified such that one or more faces of at least one jut has been flattened. Conventionally each jut will have one flattened face; in an alternative envisaged embodiment both juts will have two flattened faces on opposite sides of each jut.

DETAILED DESCRIPTION OF THE PREFERRED EMBODIMENTS

For the avoidance of doubt it should be noted that in this specification reference to 'up', 'down', 'upper', 'lower', 'vertical', 'horizontal', 'front', 'back', 'bottom', 'top' and related terms refers to the orientation that the components of the blind adopt when installed for normal use, as they are shown in the figures.

Unless otherwise stated all sizes described herein are to be taken as modified by the word 'about'.

Figure 1A:
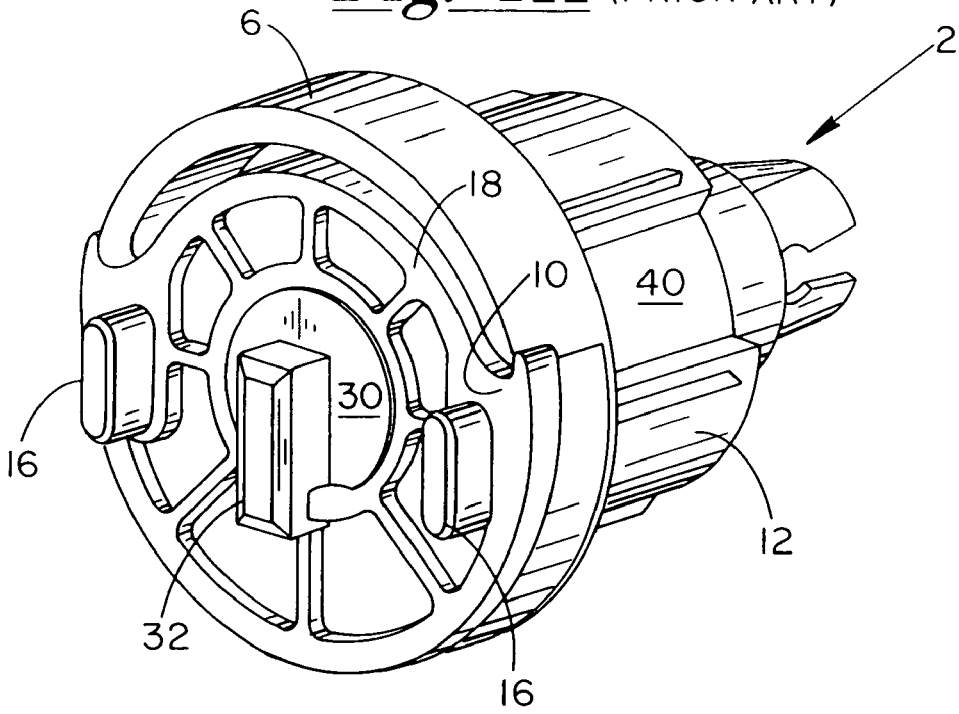
Fig.-1A (PRIOR ART)
FIG. 1*a* is a perspective view of the front of the prior art control unit as currently sold by the applicant.
Figure 1B:
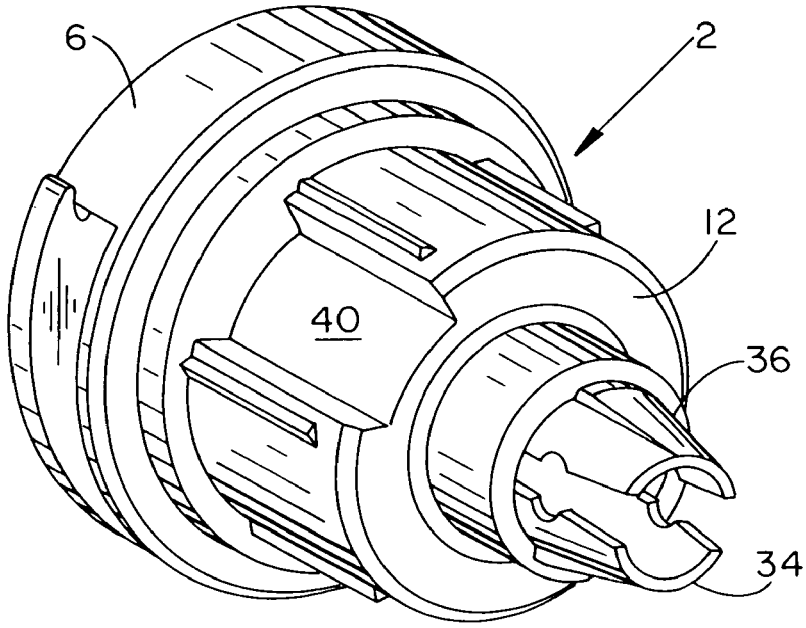
Fig.-1B (PRIOR ART)
FIG. 1*b* is a perspective view of the rear of the prior art control unit of FIG. 1*a;*
Figure 1C:
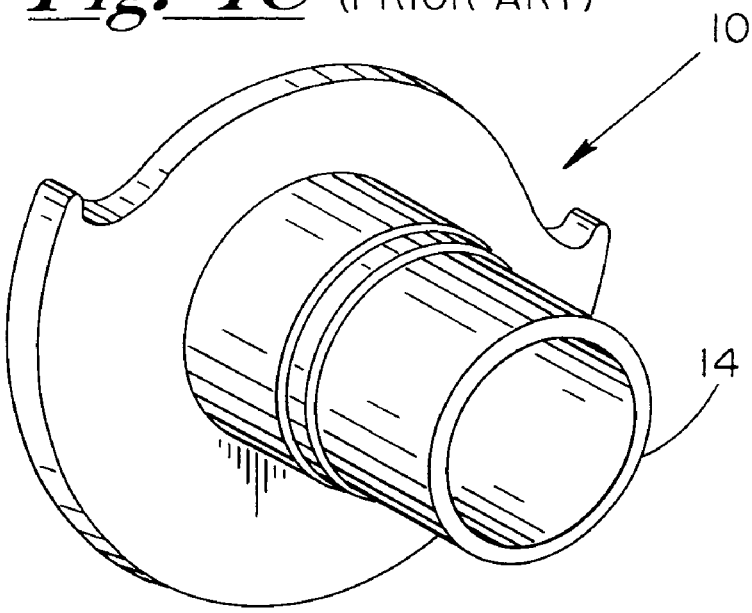
Fig.-1C (PRIOR ART)
FIG. 1*c* is a perspective view of the rear of the sprocket support of the control unit shown in FIG. 1*a;*
Figure 1D:
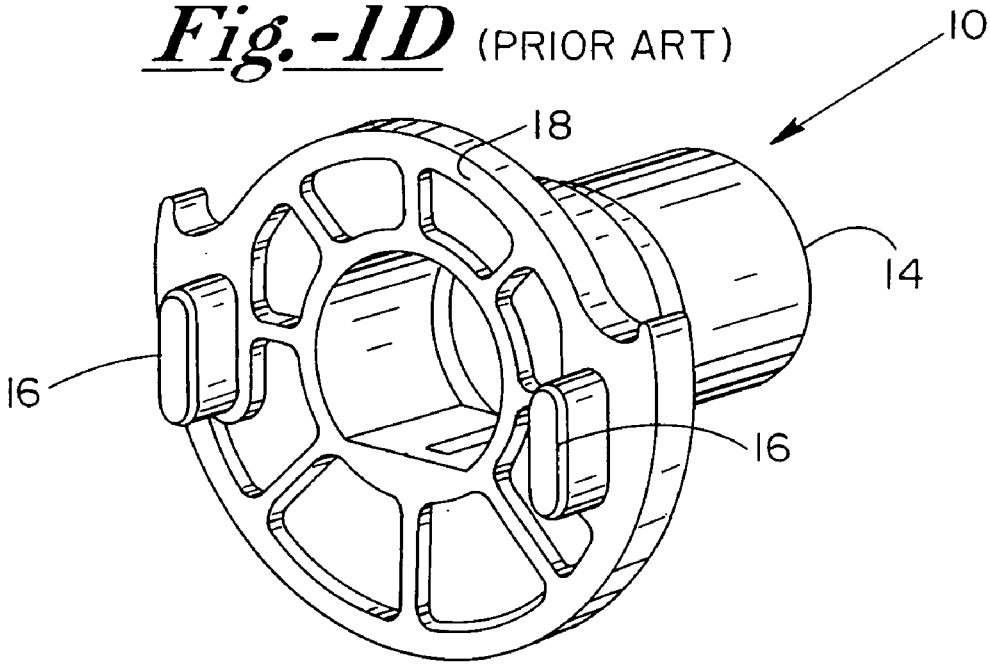
Fig.-1D (PRIOR ART)
FIG. 1*d* is a perspective view of the front of the sprocket support of the control unit shown in FIG. 1*a;*
Figure 2A:
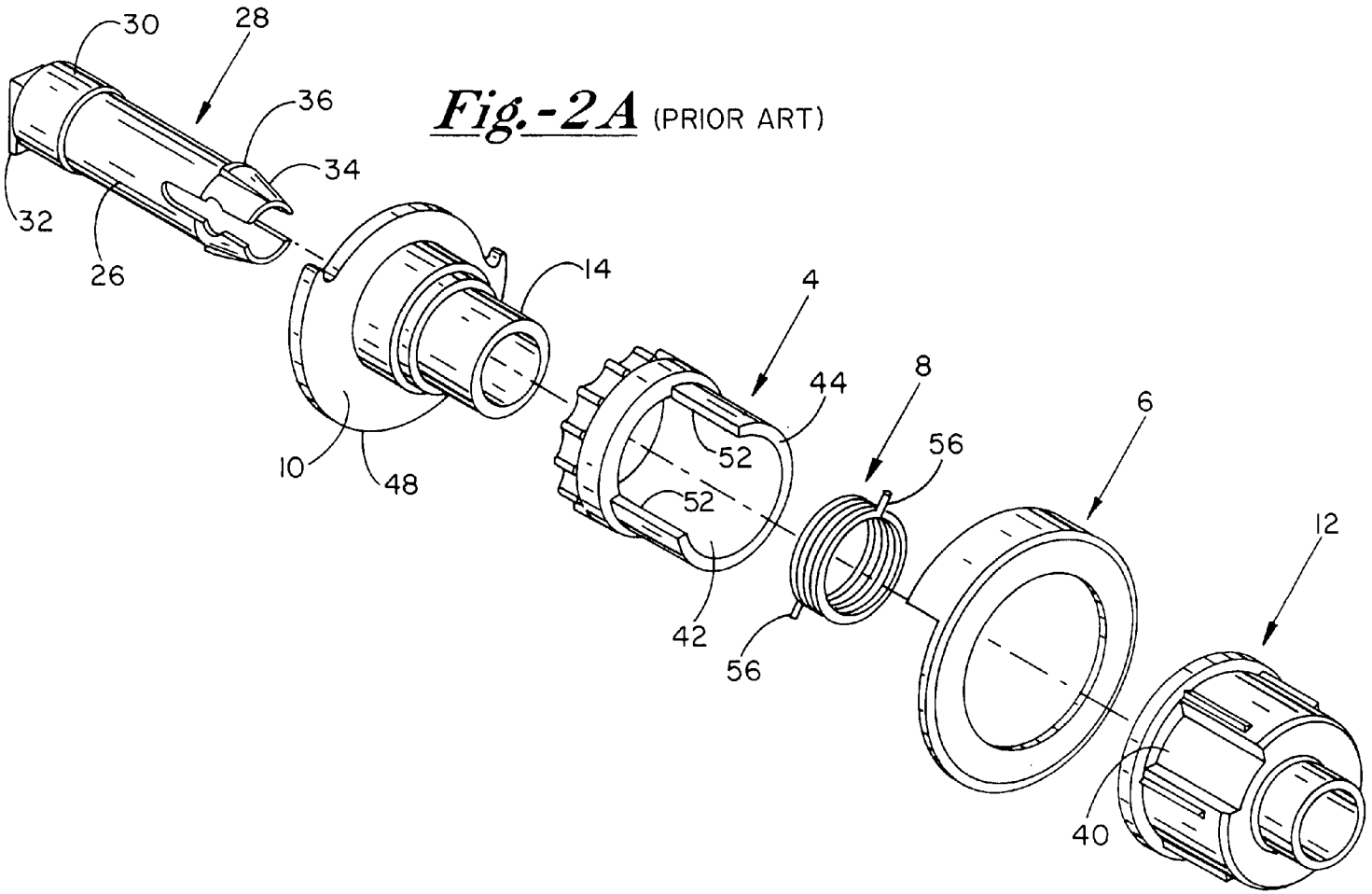
Fig.-2A (PRIOR ART)
FIG. 2*a* is an exploded perspective view from the rear of the prior art control unit of FIGS. 1*a* and 1*b;*
Figure 2B:
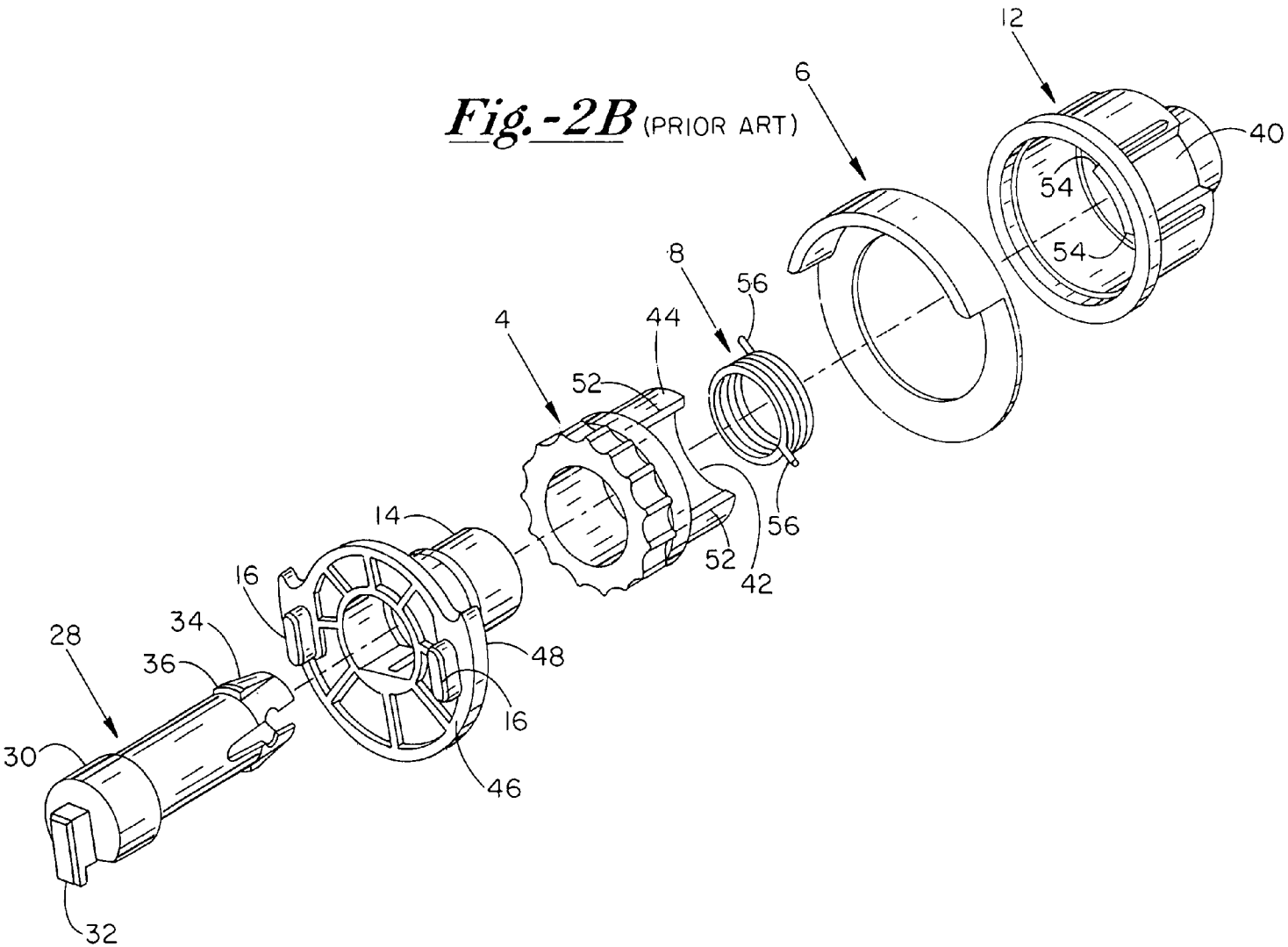
Fig.-2B (PRIOR ART)
FIG. 2*b* is an exploded perspective view from the front of the prior art control unit of FIGS. 1*a* and 1*b;*

FIGS. 1*a*–1*d* and 2*a*–2*b* show a prior control unit 2 for use with a roller blind head rail assembly. In use the unit is assembled by aligning the elements of unit as shown in FIGS. 2*a* or 2*b*, and inserting the centre pin through all elements and allowing it to lock. The control unit generally comprises a sprocket support 10, a sprocket wheel 4, a wrap spring 8, a housing 6 and a splined bush 12. Sprocket support 10 comprises a roughly cylindrical portion on which is located a sprocket spring friction surface 14, and a collar 48, which forms the external face 46 of the sprocket support.

Sprocket wheel 4 has a tubular portion 44, in which is located a cutaway portion 42.

Splined bush 12 has a moulded indent portion 40 which projects generally radially inwards from the general cylindrical body of the splined bush 12.

When assembled, pulling on the chain (not shown) causes rotation of the sprocket wheel 4.

Wrap spring 8 terminates in juts 56, which project radially outwards. In the assembled unit, juts 56 are located in the axial gap between sprocket wheel friction surface 14 and the inner surface of tubular portion 44 of sprocket wheel 4; more specifically, they sit in the gaps between edges 52 of cutaway portion 42 of the sprocket wheel 4, and moulded indent 40 of splined bush 12.

In the assembled control unit, rotation of the sprocket wheel 4 causes edges 52 of cutaway portion 42 to abut against internal sides 54 of moulded indent 40, and hence rotate splined bush 12. Which edge 52 of cutaway portion 42 abuts against which side 54 of moulded indent 40 is determined by the direction of rotation of sprocket wheel 4, which in turn is determined by which direction around the sprocket wheel 4 the chain is pulled. Accordingly, in a full assembly, the blind is raised or lowered.

A steel wrap spring 8 which engages in turn both the sprocket support 10 and sprocket wheel 4 controls the speed of rotation.

Steel wrap spring 8 rests on sprocket spring friction surface 14, and tightly grips it when the chain wheel 4 is static. This surface is part of sprocket support 10. When the chain is pulled and chain wheel 4 is caused to rotate, this causes the tubular portion 44 of sprocket wheel 4 to rotate, and eventually causes an edge 52 of cutaway portion 42 to abut against a side 54 of moulded indent 40. Rotation of sprocket wheel 4 does not instantaneously cause rotation of splined bush 12, since cutaway portion 42 always represents a greater portion of arc in size that does moulded indent 40, so there is always some play between then until rotation of the sprocket wheel 4 eventually causes rotation of splined bush 12.

In addition, as has been indicated earlier, in the assembled unit juts 56 of wrapping 8 are located between the edges 52 of cutaway portion 42 and the sides 54 of moulded indent 40. Rotation of sprocket wheel 4 which causes abutment of an edge 52 of cutaway portion 42 against a side 54 of moulded indent 40 also causes at the same time a jut 56 to be pushed in a direction which effectively opens wrap spring 8 to temporarily release its relatively tight grip on sprocket spring friction surface 14. When the rotation force on sprocket wheel 4 is ceased, so is the rotational force on jut 56, which allows wrap spring to return to its normal relatively tight grip on sprocket spring friction surface 14.

Sprocket support 10 includes two engaging pins 16 projecting from the external face 18 of sprocket support 10 and aligned at the outside edge of external face 18 of sprocket support 10 with long axes parallel to one another and parallel to the locking-lug of the centre-pin stop element 32. Engaging pins 16 and centre pin stop element 32 are received by cooperating recesses in a mounting bracket when the blind is installed.

Centre pin 28 holds the components together and has a body 26 which extends substantially through the centre of control unit 2. Centre pin 28 has two centre pin tips 34 which are shaped to include two locking lugs 36 over which splined bush 12 snaps into position.

The features described in the two specific examples of the invention may be used alone or in combination as appropriate for the needs of the user and the manufacturer.

For clarity, equivalent features of the inventive control end are given the same reference numeral with, in the first embodiment, 100, and in the second embodiment, 200, added to the number.

Figure 3B:
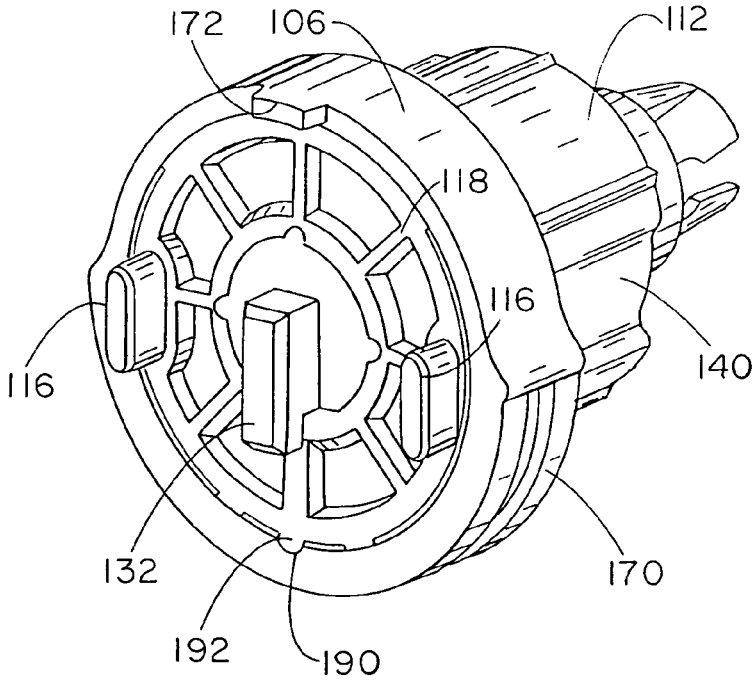
FIGS. 3*a* and 3*b* are rear and front perspective views of a control unit according to an embodiment of the invention.
Figure 3A:
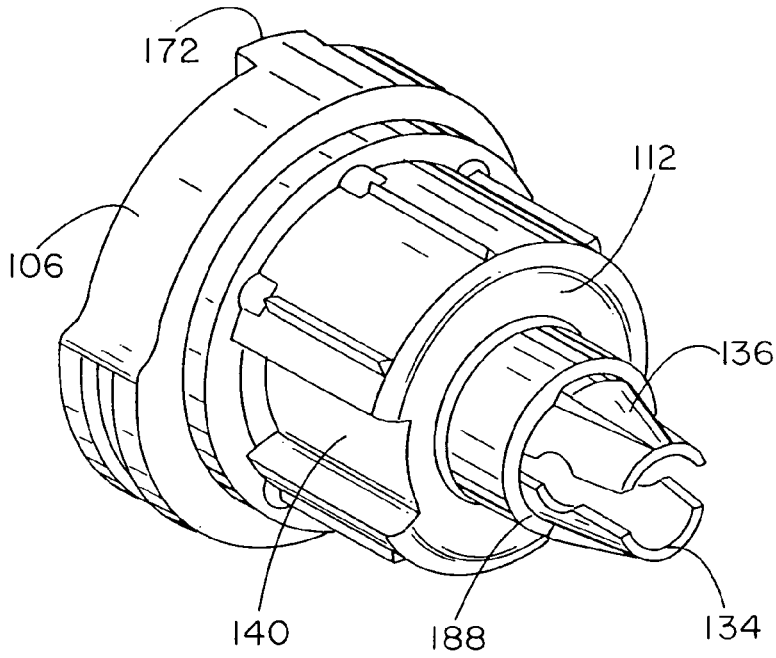
Figure 4A:
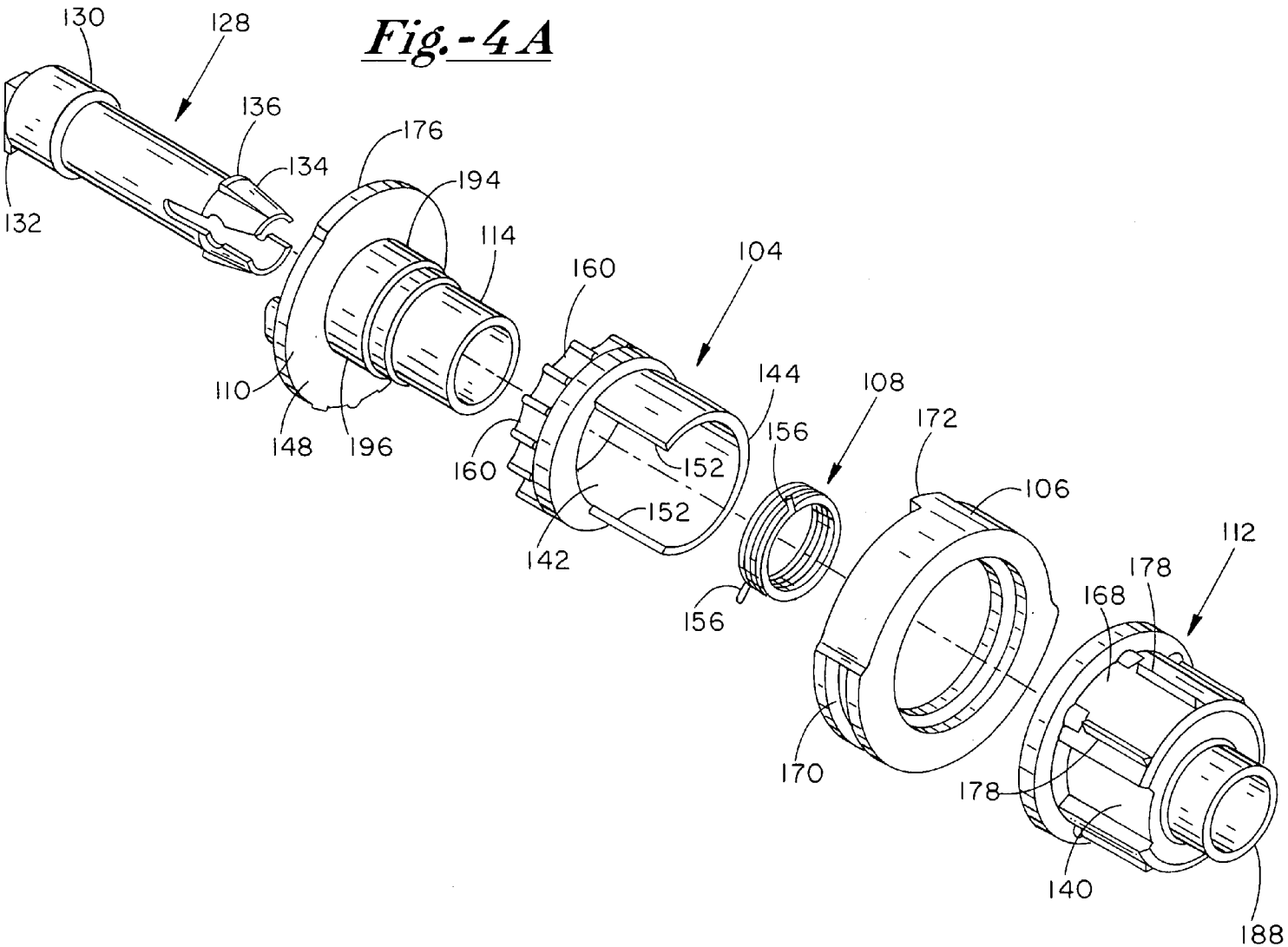
FIGS. 4*a* and 4*b* are perspective exploded rear and front views of the control unit of FIGS. 3*a* and 3*b;*
Figure 4B:
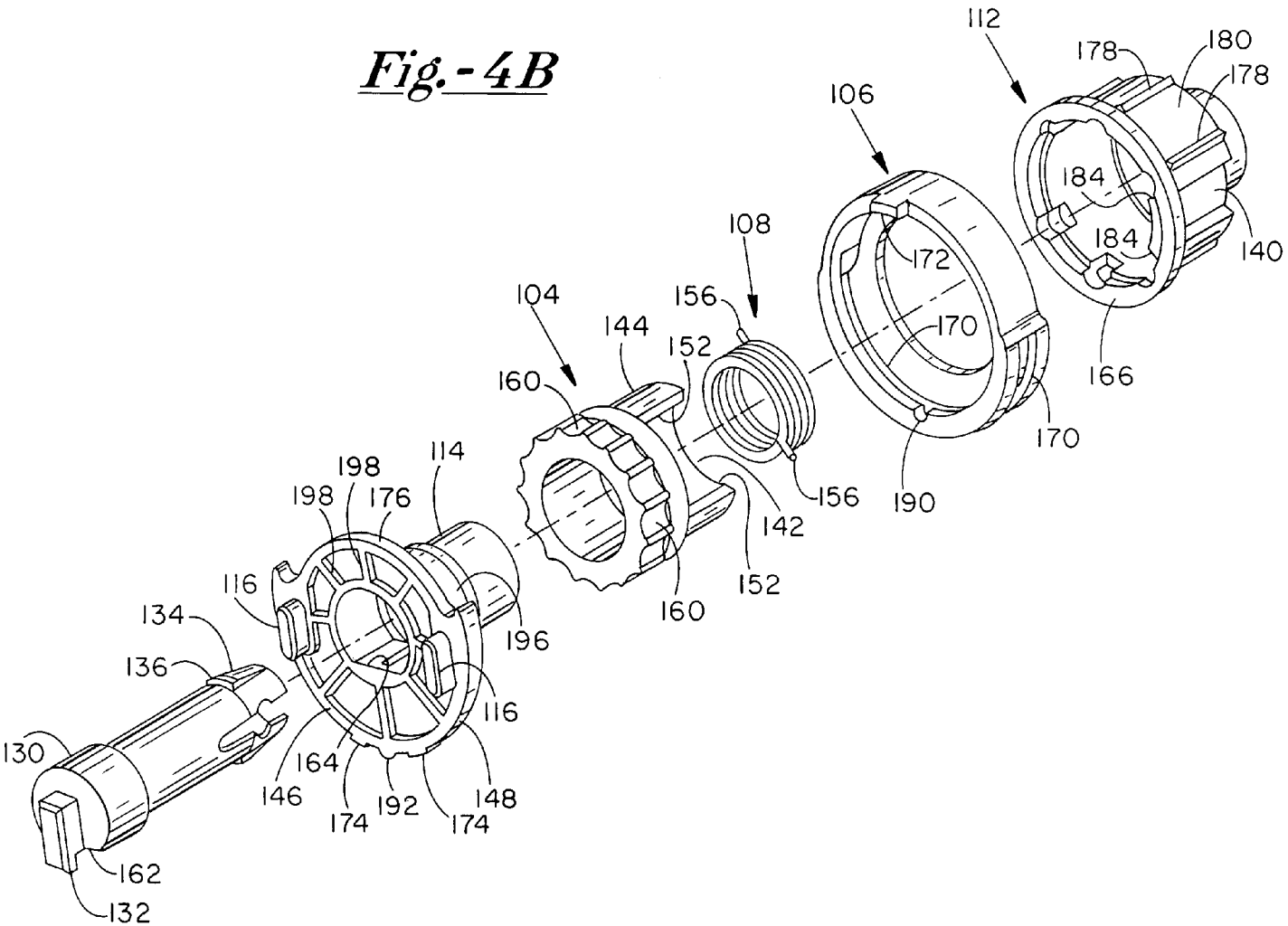

FIGS. 3*a* and 3*b* provide a perspective view of one embodiment of an assembled control unit 102 according to the invention, and FIGS. 4*a* and 4*b* provide an exploded view of the inventive control unit showing the internal components. The control unit of this embodiment has components sized such that the splined bush 112 will engage a 32 mm diameter roller blind tube.

The sprocket wheel 104 of the invention has the same function as sprocket wheel 4 of prior art control unit 2. Wheel 104 is formed from nylon, and forms a partial cylinder. At a first end, positioned in use towards the face of control unit 102 which incorporates the sprocket support 110, directly behind the external face 118 of sprocket support 110 is sprocket wheel 104 itself, comprising regularly spaced recesses 160 designed to accommodate the balls of a chain during use.

The chain for use with this control unit will typically comprise a chord of metal or plastic links with a series of balls spaced e.g. 7 mm or so, which may engage recesses 160 (but not necessarily each recess; the chain may for example engage every other recess). The chain is held in place by the inner annular surfaces of housing 106. It is this interaction between the chain and sprocket wheel 104 which when the chain is pulled causes rotation within the unit. The opposite end of the sprocket wheel component comprises a cut-away portion 142, the edges of the cut-away portion 152 engaging the wrap spring juts 156 and the moulded indent 140 of splined bush 112 in use, forcing these components to rotate.

Sprocket wheel 104 is covered by a chain guard housing 106 positioned substantially flush with external face 118 of sprocket support 110 and sized to surround and loosely engage external face 118 of sprocket support 110. Chain guard housing 106 also comprises an aperture 170 through which the chain hangs.

In this embodiment, the chain guard housing 106 comprises one lug 172, formed during the moulding of this component. Lug 172 is positioned to extend perpendicular to the face of control unit 102 which incorporates the sprocket support 110 and from the top centre of this face when control unit 102 is in use. Preferably, the mounting bracket for mounting this control unit has a recess which cooperates with lug 172 during assembly, and ensures that the chain guard (which is otherwise capable of rotating about the sprocket wheel) is correctly orientated when assembled. Preferably, the correct orientation provides for the aperture 170 to be situated pointing symmetrically vertically downwards, which in turn facilitates the chain to hang vertically downwards.

Chain guard housing 106 also features a small groove 190 positioned at the bottom centre of the housing on the face of control unit 102 which incorporates sprocket support 110. Groove 190 is adapted to receive and loosely engage with a small rounded projection 192 which extends radially from the outer edge of external face 118 of sprocket support 110. This allows chain guard housing 106 and sprocket support 110 to rotate independently when orbital pressure is applied to the unit, and yet allows the two components to remain releasably detained in a preferred configuration during use.

Figure 5A:
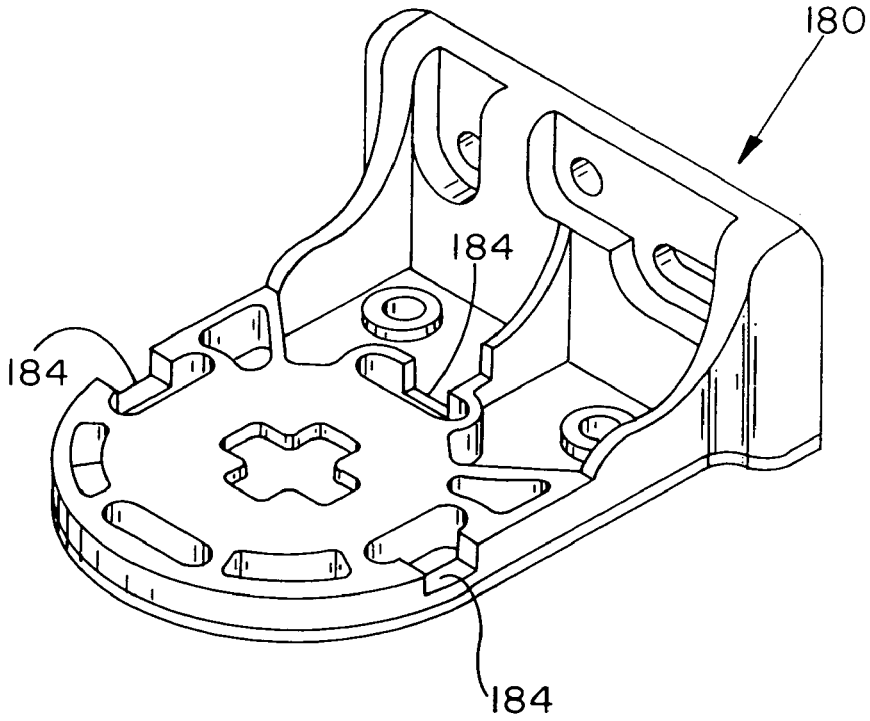
FIG. 5*a* is a perspective view of a plastic bracket adapted to receive the control unit of the first embodiment of the invention.
Figure 5B:
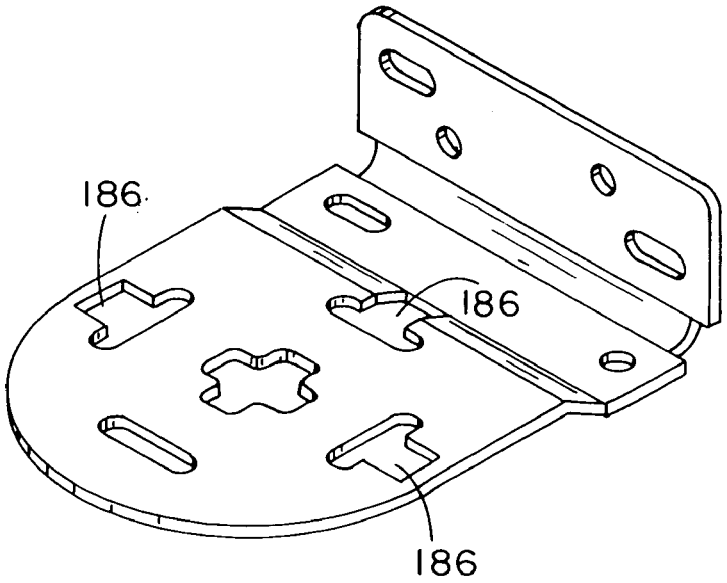
FIG. 5*b* is a perspective view of a metal bracket adapted to receive the control unit of the first embodiment of the invention.

Mounting brackets 180 or 182, which maybe made of metal or plastics, such as those for example shown in FIGS. 5*a* and 5*b*, may be used to mount the blind across the window or other aperture. Bracket 180, which may be made of injection moulded plastics materials, has been modified from those known in the art (see for example UK design registration numbers 2106405 and 2104201) through the insertion of three additional recesses 184. The recesses 184 are necessary to accommodate lug 172 found on the face of control unit 102 which incorporates sprocket support 110. Bracket 182, which may be made of metal, is adapted to interact with this embodiment of the invention by extending three of the receiving cavities 186 out towards the edge of the bracket, thereby facilitating engagement with lug 172. Three channels are incorporated, although only one additional lug 172 is present in this embodiment so that the number of manufactured stock items may be kept to a minimum. The modified plastic and metal brackets 180 and 182 will engage control unit 102 in any of three different orientations.

Figure 6A:
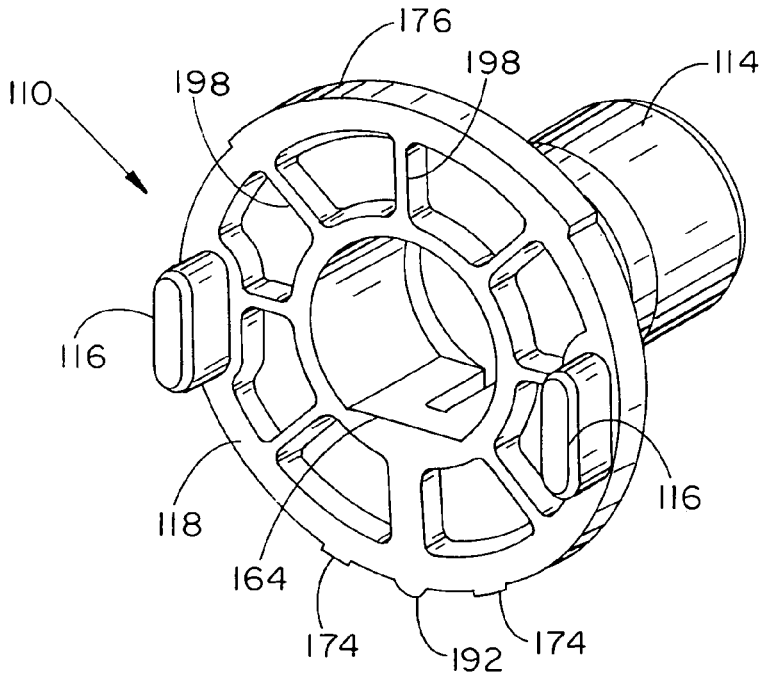
FIG. 6*a* is a perspective view of the front of the sprocket support of the embodiment of FIGS. 3 and 4.
Figure 6B:
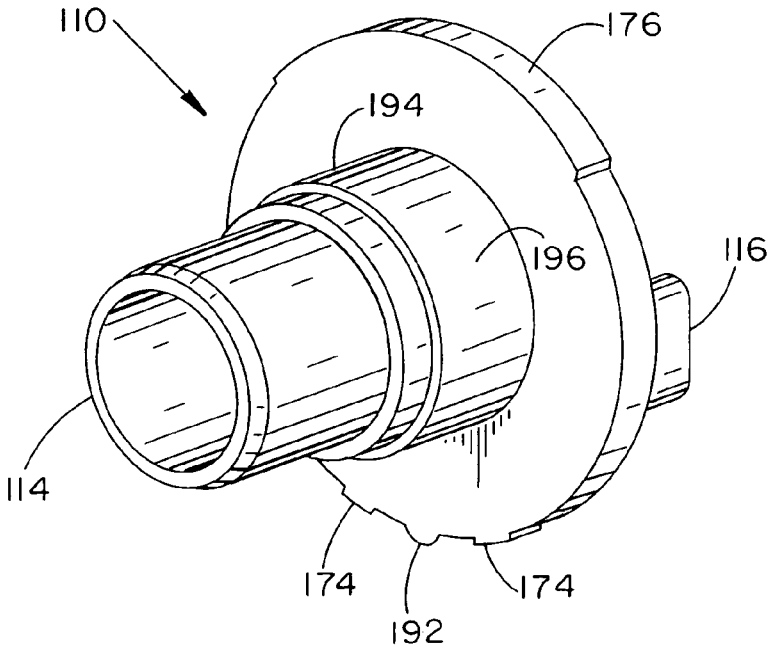
FIG. 6*b* is a perspective view of the rear of the sprocket support of the embodiment of FIGS. 3 and 4.
Figure 7B:
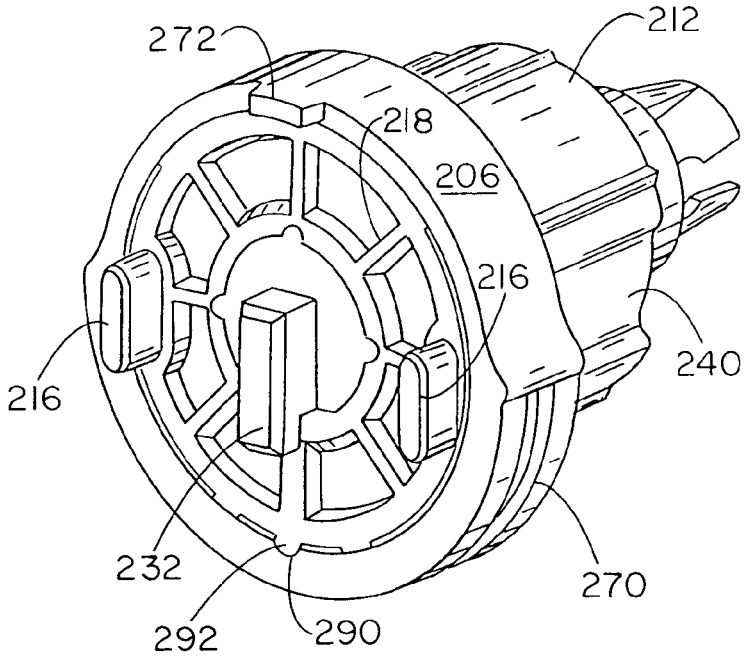
FIGS. 7*a* and 7*b* are rear and front perspective views of a control unit according to a second embodiment of the invention.
Figure 7A:
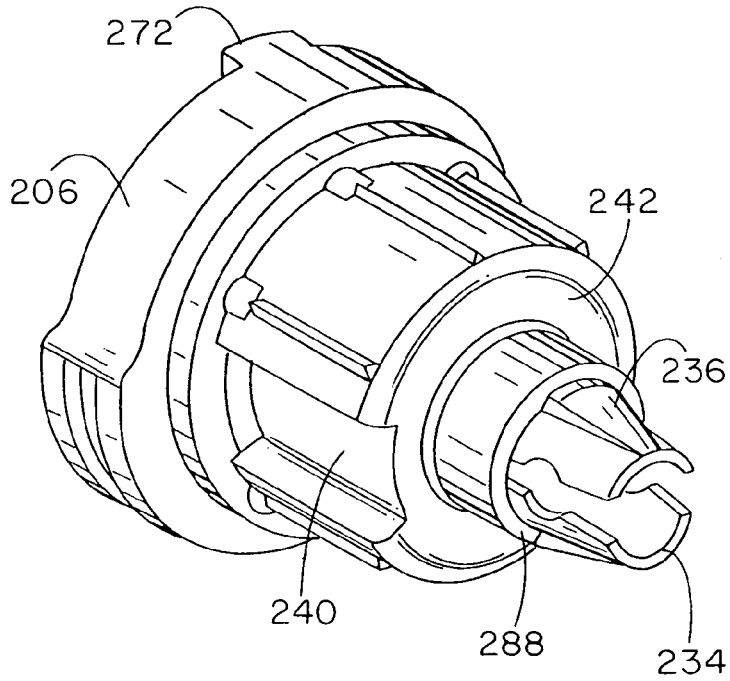
Figure 8A:
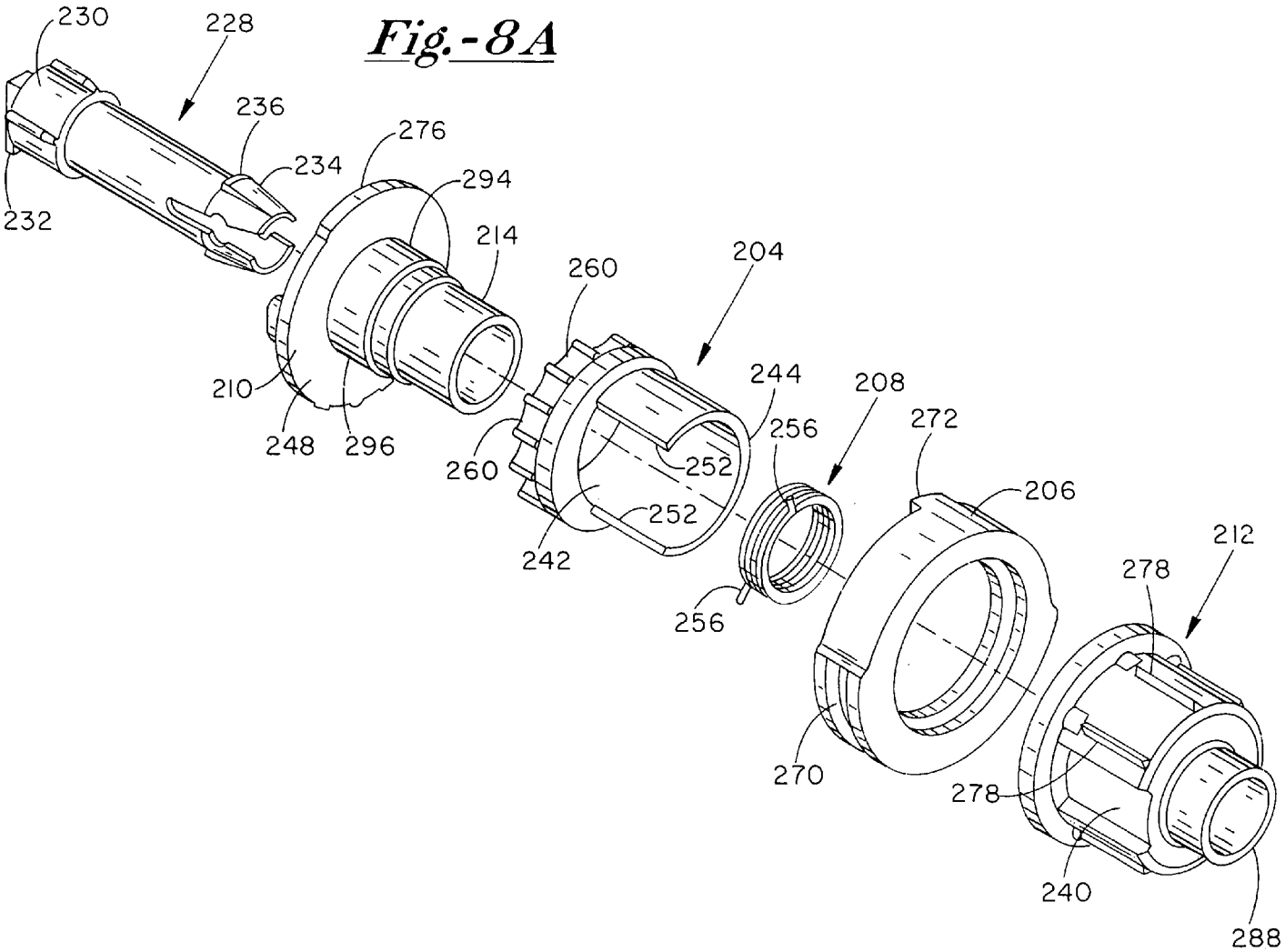
FIGS. 8*a* and 8*b* are rear and front exploded perspective views of the control unit according to FIGS. 7*a* and 7*b;*
Figure 8B:
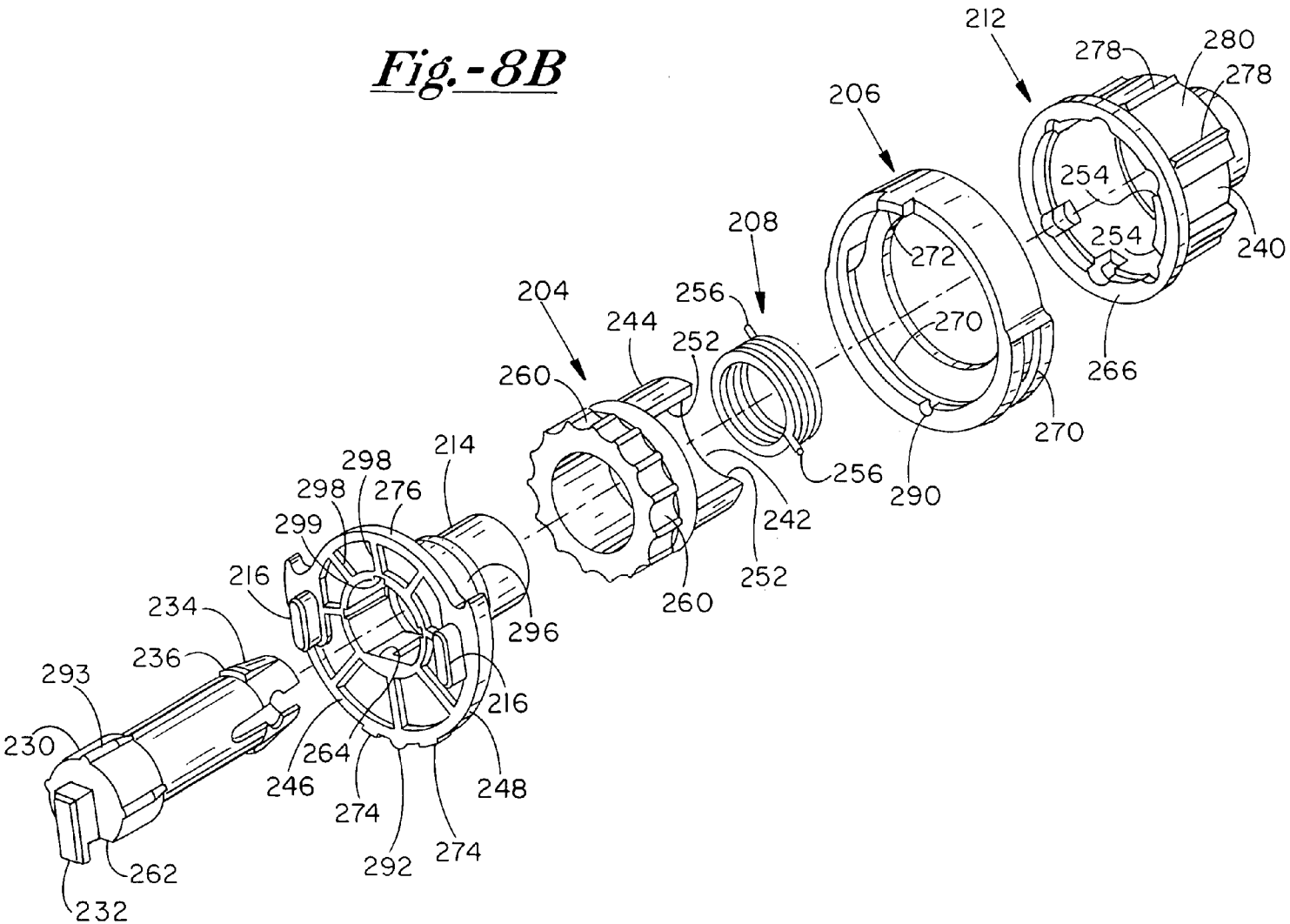
Figure 9A:
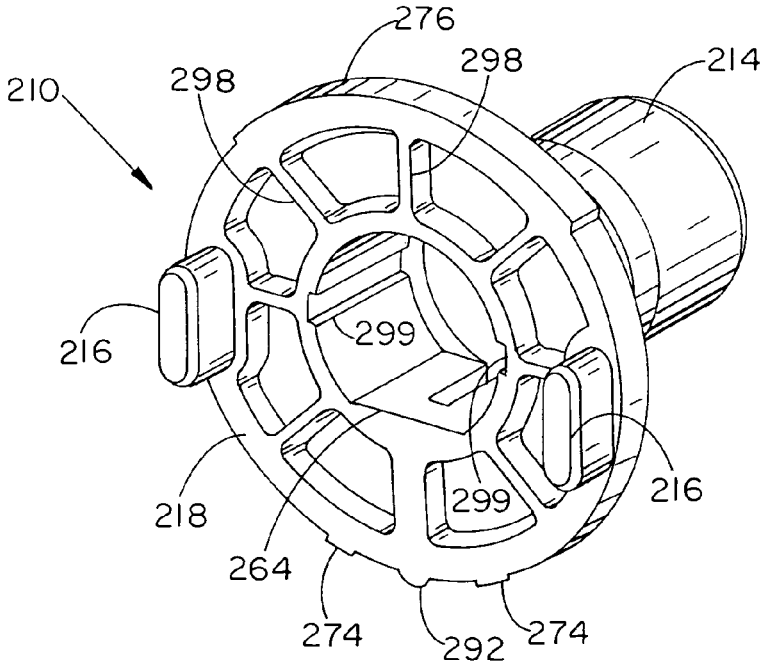
FIGS. 9*a* and 9*b* are front and rear perspective views of the sprocket support of the embodiment of FIGS. 7 and 8.
Figure 9B:
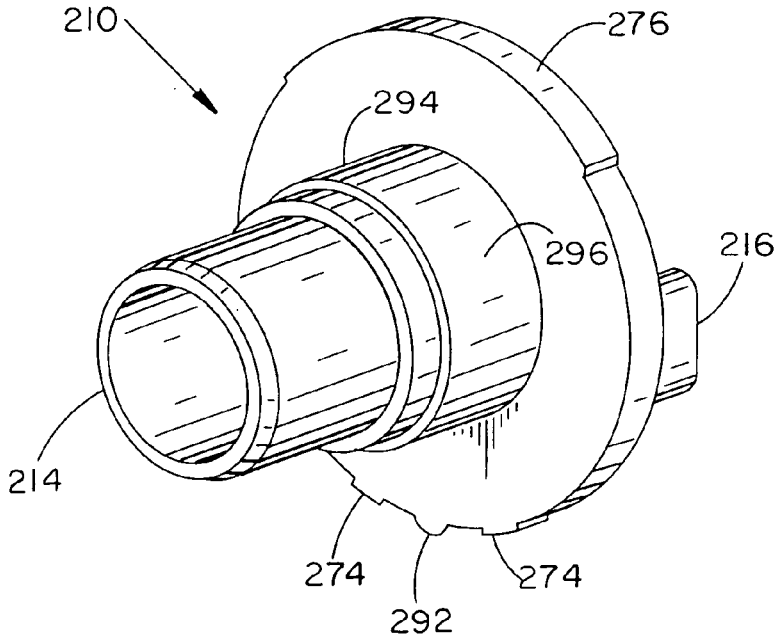

FIGS. 6*a* and 6*b* show the sprocket support 110 of an embodiment of the invention in more detail. Sprocket support 110 comprises sprocket support face 118 which is substantially annular and has extending towards the rear of control unit 102 from the inner edge of the ring, a roughly cylindrical portion 194. In this embodiment, sprocket support 110 is injection moulded from e.g. nylon. The cylindrical portion 166 of this component is of two diameters, the larger diameter portion 196 of the cylinder extending directly from sprocket support face 118 and of a size to rotatably engage sprocket wheel 104. The smaller diameter portion of the cylinder provides a sprocket spring friction surface 114 and extends beyond the larger diameter portion 196 towards the rear of control unit 102.

Wrap spring 108 rests on and engages sprocket spring friction surface 114 which interacts with, and provides a friction fitting surface for the spring. The friction generated between these two components prevents rotation of the blind until a certain minimum rotation force is applied to the control unit, by pulling the chain. As described herein, once the minimum force has been exceeded, the wrap spring effectively temporarily releases itself from sprocket spring friction surface 114, and permits rotation. In addition, it is the friction caused by the movement of these two components relative to one another, which controls the speed of rotation of the elements of control unit 102.

The external face 118 of sprocket support 110 includes regularly spaced radial strengthening spines 198. In addition, this face includes two engagement pins 116 which are rectangular with rounded corners, positioned mid-way up the face and substantially at either edge of external face 118 of sprocket support 110 with their long axes parallel to the long axis of locking-lug of the centre-pin stop element 132. Engagement pins 116 project outwards from external face 118 of sprocket support 110 and interact with a mounting bracket when the blind is in use.

In the present embodiment, two small angular contact projections 174 and one angular contact surface 176 extend radially from the edge of external face 118 of sprocket support 110. The angular contact projections and surfaces 174 and 176 are in frictional contact with the inner surface of chain guard housing 106.

There is a central bore through each component of the control unit. This bore is designed to receive centre pin 128. Centre pin 128 is of plastics construction and operates in the same way as prior art centre pin 28 described above. Like the prior art centre pin, it has a flattened surface 162 which cooperates with a corresponding flattened surface 164 on sprocket support 110 to prevent rotation between them.

On assembly a splined bush 112 snap fits over two centre pin lugs 136. As with centre pin 128, splined bush 112 is of one-piece plastics construction. Splined bush 112 comprises a cap front 166 which lies adjacent to the rear face of chain guard housing 116 in use. Extending through the control unit, away from chain guard housing 116, the cap front 166 is connected to a roughly cylindrical portion 168 the external surface of which incorporates a series of splines 178. It is this surface which provides purchase on, and causes rotation of, the roller blind tubing. This cylindrical portion 168 of the splined bush 112 also comprises a moulded indent 140 of width about $\frac{1}{8}^{th}$ the circumference of the cylindrical portion 168. As previously described, in use rotation of the sprocket wheel 104 causes the inner surface of this indent to be engaged by the edges 152 of cut-away portion of the sprocket wheel cylinder 142, which causes rotation of splined bush 112.

The most rearward portion of splined bush 112 is the centre pin lug engagement surface 188 and it is this interaction with centre pin lugs 136 that holds the control unit together during operation.

A second embodiment of the invention is described below with reference to FIGS. 7*a* and 7*b*, 8*a* and 8*b* and 9*a* and 9*b*. The control unit 202 of this embodiment has components sized that the splined bush 212 will engage a 45 mm diameter roller blind tube.

The sprocket wheel 204 of this embodiment has the same function as sprocket wheels 4 and 104 described above, although the relative dimensions will be greater as control unit 202 is designed for use with a larger blind.

Chain guard housing 206 in this embodiment, corresponds to chain guard housing 6 of prior art control unit 2. The optional additional lug has not been included as a feature of control unit 202. All other features of chain guard housing 206 correspond to those of chain guard housing 106 of the first embodiment.

Sprocket support 210 is generally similar to sprocket support 110. Sprocket support 210 comprises a sprocket support face 218, a cylindrical portion 266 of two diameters, one engaging sprocket wheel 204 and one providing a sprocket spring surface 214 for engagement with wrap spring 208.

Figure 10A:
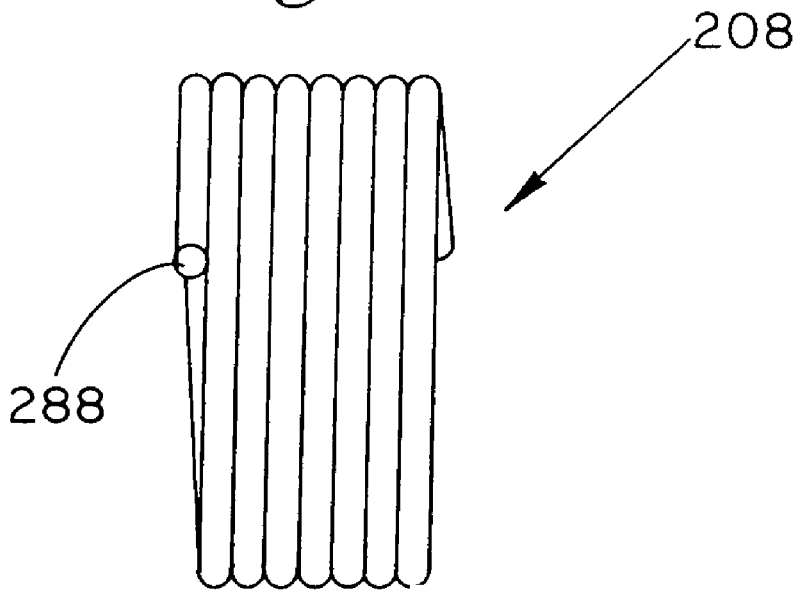
FIG. 10*a* is a side view of the modified wrap spring according to the second embodiment of the invention.
Figure 10B:
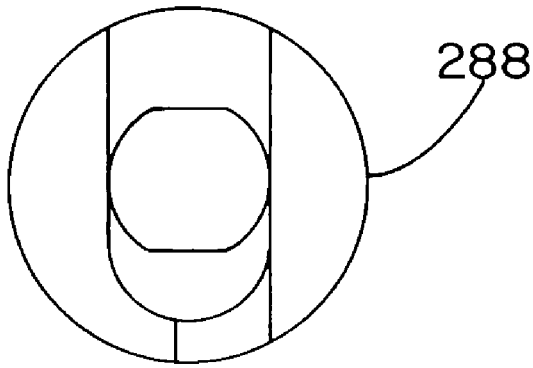
FIG. 10*b* is a plan view of the end of the wrap spring jut of FIG. 10*a*.

Wrap spring 208, shown in FIG. 10*a*, comprises seven full coils of steel (wound to the left) plus an additional part coil corresponding to an additional 155°. Two juts 256 extend outwards from the coil. The coil has a circular cross-section. However, the juts 256 have been flattened to form a non-circular cross-section (FIG. 10*b*) in which two opposite faces of the jut have been flattened. This increases the contact area with the edge of the cutaway portion 242 of sprocket wheel 204.

The external face 218 of sprocket support 210 includes strengthening splines 272, and engagement pins 216 as described in the context of the first embodiment. Sprocket support 210 of the present embodiment additionally comprises three recesses 299 positioned around, and extending radially from, the inner surface of the ring of sprocket support face 218 which receives centre pin head 230. Recesses 299 are spaced 90° apart on the left, right and at the top of the inner edge when the control unit is in use.

Recesses 299 are adapted to receive three fins 293 which extend from the centre-pin head 230. Centre-pin head 230 additionally comprises a locking-lug of the centre-pin stop element 232. These features engage the external face 218 of sprocket support 210. The centre pin 228 extends through the central bore of control unit 202. At the rear of control unit 202 there are two centre pin tips 234 each comprising a locking lug 236 over which splined bush 212 snaps into position. Splined bush 212 has the same features as splined bushes 12 and 112 described above.

The invention claimed is:

1. A control unit for use in a window blind head rail assembly comprising;

a sprocket wheel, a chain guard housing, a sprocket support and wrap spring, a splined bush for engagement with a roller blind tube and a centre pin, wherein the centre pin comprises a centre-pin head and a body, the centre-pin head including one or more fins adapted to co-operatively engage with one or more recesses in the sprocket support.

2. The control unit of claim 1 wherein the centre-pin head comprises three fins.

3. The control unit of claim 1 or claim 2 wherein there are one or more lugs extending perpendicular to the face of the control unit.

4. The control unit of claim 3 wherein the lug or lugs are part of the chain guard housing.

5. The control unit of claim 1 wherein the wrap spring is of circular cross-section and includes wrap spring juts having one or more flattened surfaces.

6. The control unit of claim 1, including a releasable lock mechanism releasably retaining the sprocket support in a first rotational orientation with respect to the chain guard housing, the releasable lock mechanism having a first engagement feature disposed at the sprocket support, and a second engagement feature disposed at the chain guard housing.

7. A control unit for use in a window blind head rail assembly comprising; a sprocket wheel, a sprocket support comprising a portion of a front face of the control unit and wrap spring, a splined bush for engagement with the roller blind tube a chain guard housing comprising one or more lugs extending perpendicular to the front face of the control unit and away from the splined bush, such that the one or more lugs operably engage with a control unit mounting bracket, and a centre pin.

8. A control unit as in claim 7 wherein said wrap spring includes wrap spring juts extending from a body portion of the wrap spring wherein the wrap spring juts have a non-circular axial cross-section, and wherein the body portion of the wrap spring is of circular axial cross-section.

9. The control unit of claim 7, including a releasable lock mechanism releasably retaining the sprocket support in a first rotational orientation with respect to the chain guard housing, the releasable lock mechanism having a first engagement feature disposed at the sprocket support, and a second engagement feature disposed at the chain guard housing.

* * * * *